US008959946B2

(12) United States Patent
Görz et al.

(10) Patent No.: US 8,959,946 B2
(45) Date of Patent: Feb. 24, 2015

(54) REFRIGERATOR HAVING AN INSULATED COOL AIR DUCT

(75) Inventors: Alexander Görz, Aalen (DE); Hans Ihle, Giengen (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 1850 days.

(21) Appl. No.: 11/918,597

(22) PCT Filed: Mar. 24, 2006

(86) PCT No.: PCT/EP2006/061038

§ 371 (c)(1),
(2), (4) Date: Oct. 15, 2007

(87) PCT Pub. No.: WO2006/120058

PCT Pub. Date: Nov. 16, 2006

(65) Prior Publication Data

US 2009/0056364 A1 Mar. 5, 2009

(30) Foreign Application Priority Data

May 10, 2005 (DE) ..... 10 2005 021 613

(51) Int. Cl.
*F25D 17/06* (2006.01)

(52) U.S. Cl.
CPC ..... *F25D 17/065* (2013.01); *F25D 2317/0653* (2013.01); *F25D 2317/067* (2013.01); *F25D 2400/04* (2013.01)
USPC ..... 62/414; 62/419

(58) Field of Classification Search
USPC ..... 62/419, 414
See application file for complete search history.

(56) References Cited

U.S. PATENT DOCUMENTS

| | | | | |
|---|---|---|---|---|
| 3,027,735 | A * | 4/1962 | Preotle et al. | 62/407 |
| 3,104,533 | A * | 9/1963 | O'Connell | 62/414 |
| 3,466,891 | A | 9/1969 | Maxwell | |
| 5,034,647 | A | 7/1991 | Ohtsuka | |
| 5,495,726 | A * | 3/1996 | Lee | 62/413 |
| 5,819,552 | A | 10/1998 | Lee | |
| 6,044,654 | A * | 4/2000 | Igari et al. | 62/186 |
| 6,112,542 | A | 9/2000 | Lee | |
| 6,401,482 | B1 * | 6/2002 | Lee et al. | 62/408 |

OTHER PUBLICATIONS

International Search Report PCT/EP2006/061038.

* cited by examiner

*Primary Examiner* — Cassey D Bauer
(74) *Attorney, Agent, or Firm* — James E. Howard; Andre Pallapies

(57) ABSTRACT

A refrigerator is provided having an outer housing and an inner housing which is at a distance from the outer housing and is surrounded by the latter, with the hollow space produced between the outer housing and the inner housing being filled with foam for insulation purposes. An inner chamber is surrounded by the inner housing and is cooled by the circulation of cooling air supplied to the inner chamber by means of a cooling-air duct and is arranged between the outer housing and the inner housing. A method is provided for forming the cooling-air duct from a shaped part that has insulating material and a closed rear-wall element and rests on an outer face of the inner housing.

21 Claims, 3 Drawing Sheets

REFRIGERATOR HAVING AN INSULATED COOL AIR DUCT

The invention relates to a refrigerator with an outer housing, having an inner housing which is at a distance from the outer housing and is surrounded by the latter, with the hollow space produced between the outer housing and the inner housing being filled with foam for insulation purposes, also having an inner chamber which is surrounded by the inner housing and is cooled by the circulation of cooling air which is supplied to the inner chamber by means of a cooling air duct which serves to distribute cooling air and is arranged between the outer housing and the inner housing.

BACKGROUND OF THE INVENTION

These types of refrigerators also referred to as no-frost refrigerators, are known in the prior art. As a rule they contain a cooler located outside the inner chamber ventilated by a ventilator, such as an evaporator for example past which air sucked out of the inner chamber is directed in order to cool said air, and to dry it but means of condensation, with the dry cool air obtained in this way being fed to the inner chamber by means of a cooling-air duct. The cooling-air duct is in this case, as shown in FIG. 2 of DE 39 32 449 C2, arranged in a heat-insulating foam structure embedded between the outer housing and the inner housing, so that this duct does not have to be specially and expensively insulated from the inner housing.

In the manufacturing of a refrigerator with a cooling-air duct arranged in this manner, this must be placed in the desired position in a preassembly stage before the hollow space between the inner housing and the outer housing is filled with foam and must be fixed in this position with retaining elements, so that the cooling-air duct remains in the desired position during the foam filling even when subjected to the forces exerted on it by the expansion of the foam. The pre-assembly of the cooling-air duct is an expensive manufacturing process and is therefore cost intensive.

SUMMARY OF THE INVENTION

The underlying object of the invention is thus to create a refrigerator of the type mentioned at the start with a cooling-air duct arranged between an outer housing and an inner housing, which in manufacturing terms can be produced more easily and thereby more cost-effectively.

This object is achieved for a refrigerator of the generic type by the cooling-air duct being formed from a shaped part made of insulating material resting against the outer side of the inner housing and by a closed rear-wall element.

With the inventive refrigerator the cooling-air duct is formed from a shaped part made of insulating material, for example hard foam made of Polystyrol, and a closed rear-wall element, with the shaped part resting on an outer face of the inner housing and thus heat-insulating the inner housing and thereby the inner chamber from the cooling-air duct. There is thus no complete embedding of the cooling-air duct into a foam structure located between outer and inner housing, so that the time and cost-intensive preparatory work mentioned above can be dispensed with and the refrigerator can thus be manufactured at low cost.

A further advantage of the inventive refrigerator lies in the spatial proximity of the cooling-air duct to the inner housing or to the inner chamber. The incidence of heat in the cooling-air duct is reduced by this arrangement and the energy consumption and thereby the operating costs of the refrigerator can be reduced in this way.

In accordance with a preferred embodiment of the inventive refrigerator the rear wall element is embodied as a U-profile with two profile legs in contact with the inner housing. This gives the opportunity of forming the cooling-air duct on a flat wall of the inner housing.

In accordance with a preferred embodiment the shaped part is embodied as an elongated plate of which the lengthwise edges each rest on one of the leg inner sides of the U-profile in order to insulate the entire cross section of the cooling-air duct from the inner chamber.

In accordance with an especially preferred embodiment the cooling-air duct comprises at least one support element which is arranged between the inner side of the rear of the U-profile and area of the inner housing facing towards the rear of the profile. When the hollow space between the outer housing and the inner housing is filled with foam, when the foam expands a comparatively high pressure arises, which in particular also imposes a load on the rear of the U-profile and can thus lead to a deformation of the channel and thereby to a reduction in its cross section. The support element counters this type of reduction of the channel cross section. The supporting effect is especially effective if the support element extends over the entire length of the cooling-air duct.

In order not to significantly adversely affect the air flow in the cooling-air duct, the support element preferably extends in the direction of the air flow along a center line of the cooling-air duct.

The elongated plate and the support element can be implemented as a one-piece component, in the form of a T-profile or of an E-profile for example. The implementation of the support element as a T-profile or as an E-profile enables, in combination with the rear wall element, two or three adjacent cooling-air ducts to be created. For the case in which the support element is embodied in cross section in the form of a comb, the spaces between the comb teeth produce a plurality of cooling-air ducts. Simultaneously this allows an especially intensive and even support for the rear wall element.

Preferably angled bars are formed along the longitudinal edges of the elongated plate, which can likewise be used to support the rear wall element or make it easier to position said element.

In accordance with an especially preferred embodiment of the invention the outer sides of the bars are at a distance from the adjacent inner sides of the legs of the U-profile, since in such a position the bars can support the rear of the U-profile more effectively.

According to a particular development of the invention there is provision for the inner housing to be provided with at least with one marking which indicates an envisaged assembly position for the shaped part on the inner housing. This facilitates the mounting of the shaped part on the inner housing.

There can also be provision, as regards fast and correct assembly of the cooling-air duct on the inner housing, for the rear panel element, preferably on a side facing towards the shaped part, to be equipped with a positioning aid to enable the rear wall element to be brought quickly and reliably into the desired position.

To provide a larger surface by means of which the U-profile can be fixed on the inner housing, in a further preferred embodiment of the invention there can be provision for the U-profile in the area of the ends of its legs to be provided with a flange.

To guarantee a connecting line between the cooling-air duct and the inner chamber for the supply of cooling air from the cooling-air duct into the inner chamber, in accordance with an especially preferred embodiment of the inventive refrigerator there is provision for the shaped part and at corresponding points the inner housing to be provided with openings through which air can pass.

The inventive refrigerator preferably involves a no-frost technology refrigerator which is preferably embodied as a household refrigerator. Such an appliance can be a refrigerator or a freezer or a so-called fridge-freezer.

BRIEF DESCRIPTION OF THE DRAWINGS

The description given below serves in conjunction with the drawing to explain the invention. The figures show.

DETAILED DESCRIPTION OF THE EXEMPLARY EMBODIMENTS OF THE PRESENT INVENTION

Figure 1:
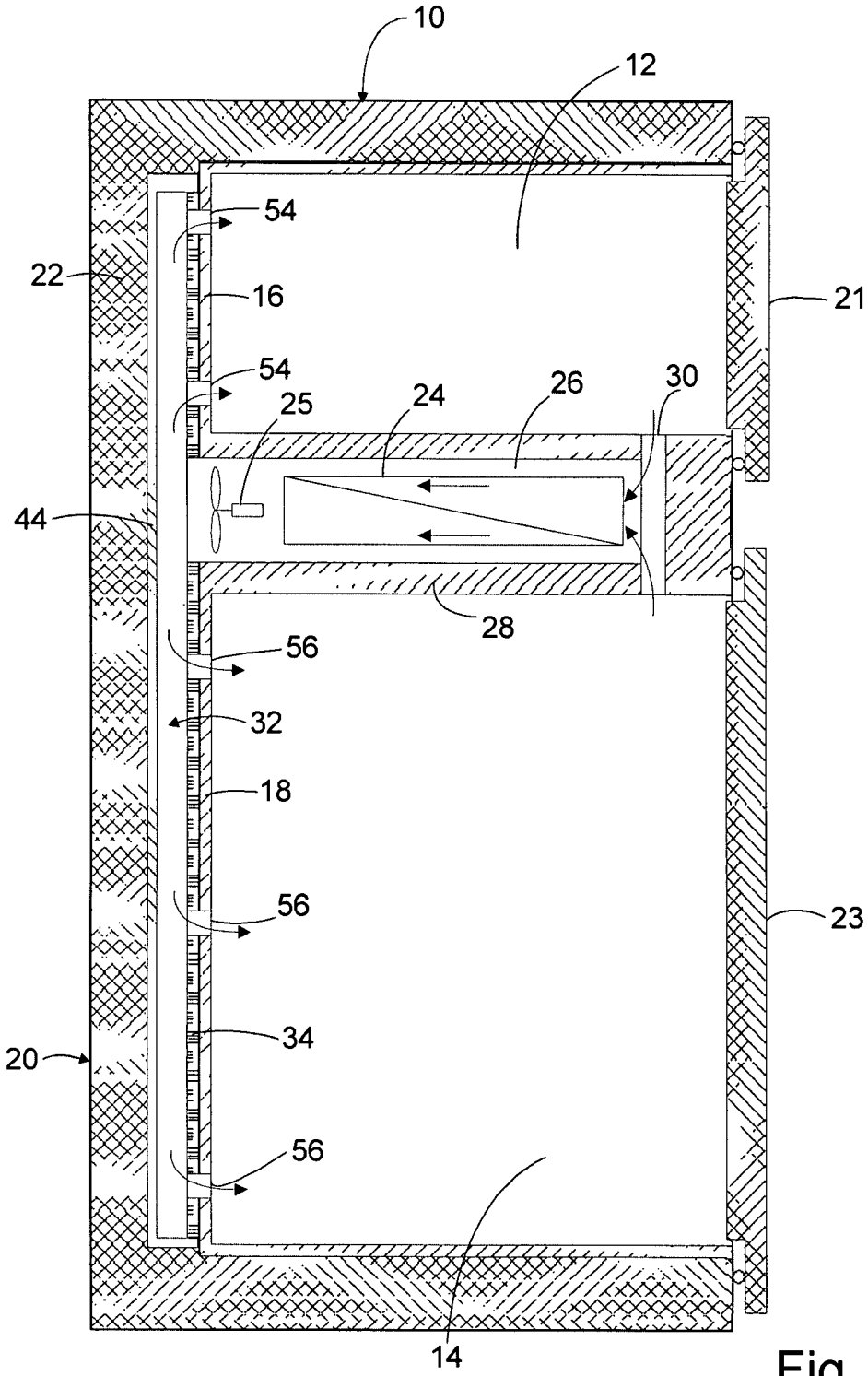
FIG. 1 a vertical sectional view of a first embodiment of an inventive refrigerator with a cooling-air duct resting against an inner housing.

FIG. 1 shows a household refrigerator identified overall with the reference symbol 10. The refrigerator comprises two internal spaces 12 and 14, which are arranged in a heat-insulating housing 20 and are each accessible via a heat-insulating door 21 or 23. The upper space 12 is embodied as a freezer compartment and lower space 14 as a fridge compartment. The inner spaces 12 and 14 are surrounded by inner housing shells 16 or 18 respectively as an inner housing which is formed from a deep-drawn plastic sheet. The space between an outer container not shown, formed from sheet metal as an outer housing and the inner housing shells 16 and 18 is filled with a foam 22 made from a plastic material, for example a polyurethane. The refrigerator is equipped in a known manner with a compressor cooling device known per se and thus not shown in the drawing, of which, for the sake of simplicity, the only individual component shown in the diagram is a coolant evaporator 24. The evaporator 24 is arranged in a chamber 26 in a heat-insulating partition floor 28 located between the inner housing shells 16 and 18.

To cool the inner spaces 12 and 14 air is sucked via a duct 30 air from the inner spaces 12 and 14 by means of a ventilator 25 and routed via the evaporator 24 located in the chamber 26 where it is cooled and dried by means of condensation. The cooled and dried cooling air is on the one hand expelled in a section of a cooling-air duct 32 leading to the freezer chamber 12, which is formed from a plate 34 made of Styropor resting on rear walls of the inner housing shells 16 and 18 as a shaped part and a U-profile 44 made of plastic material as the rear wall element and from there arrives through the outlet openings 54 in the form of air passage openings which pass through the inner housing shell 16 and the Styropor plate 34 into the inner chamber 12. On the other hand the cooling air cooled and dried by the evaporator 24 is forced out into a section of the cooling-air duct 32 leading to the refrigerator compartment and from there arrives via the vent openings 56 as air passage openings which pass through the Styropor panel 34 and the inner housing shell 18 into the inner chamber 14. The control of the introduction of cooling air into the inner spaces 12 and 14 is undertaken using thermostats and flaps in a way known per se and thus not shown in the drawing. A heating facility also not shown in the diagram is present in the partition floor 28 for de-icing the evaporator 24.

Figure 2:
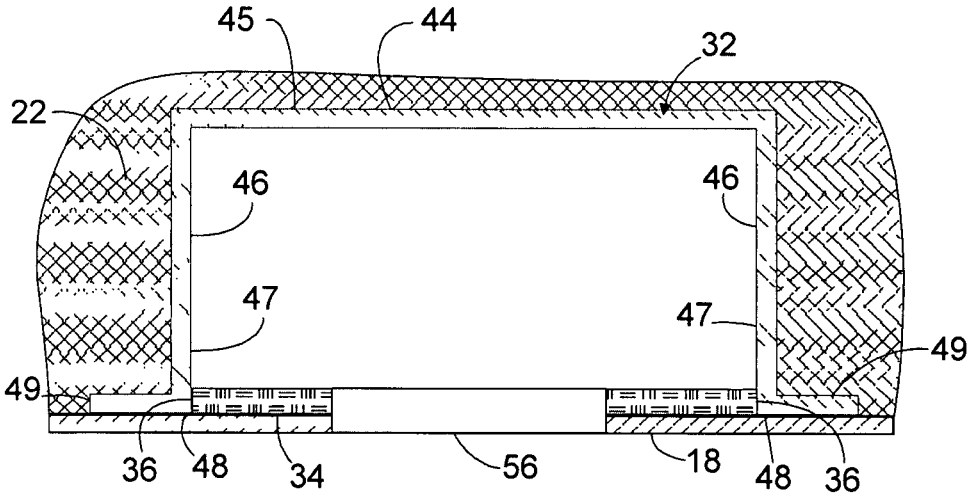
FIG. 2 a section from a horizontal cross-sectional view of the inventive refrigerator in the area of the cooling-air duct.

As can be seen from FIG. 2, the cooling-air duct 32 is formed from the plate 34 and the U-profile 44, in that the long ends 36 of the plate 34 rest against the leg inner sides 46 to form a seal. In this case the leg ends 48 are flush with the side surface of the plate 34 facing away from the rear 45 of the U-profile 44, so that they come to rest against the inner housing shell 18. The legs 47 are provided in the area of their long ends 48 in each case with a flange 49 angled towards the outer side of the respective leg 47, which rests against the rear wall of the inner housing shell 18 and is fixed with reference to U-profile 44 to the profile by an adhesive.

Figure 3:
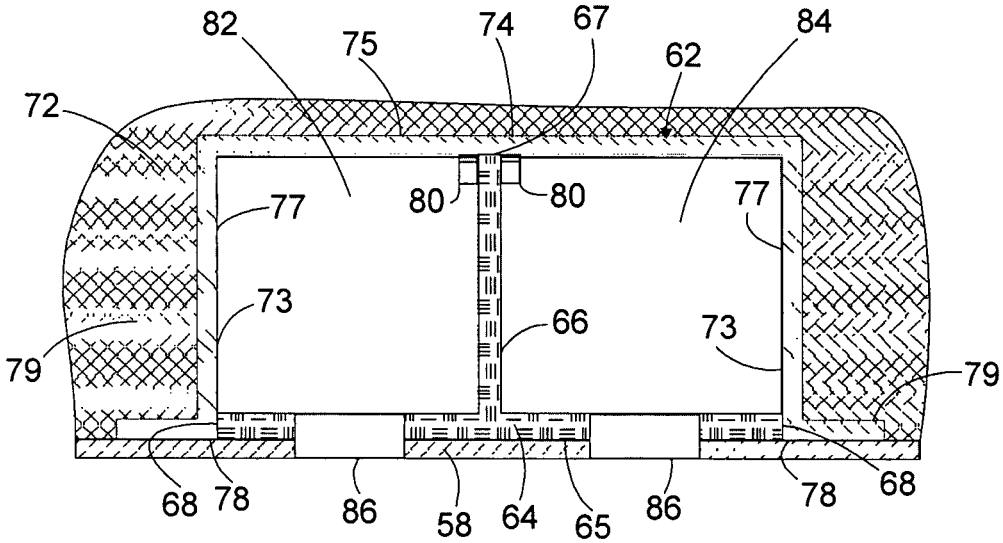
FIG. 3 a view corresponding to that shown in FIG. 2 of a second embodiment of the invention.

FIG. 3 shows a view of a second embodiment of a refrigeration device as a refrigerator similar to that shown in FIG. 2. The refrigerator comprises a cooling-air duct 62, which is constructed from a U-profile 74 as rear wall element and a T-profile 64 as shaped part. The U-profile 74, which is embedded on its outer side into a foam 72 made of plastic material, features a flange 70 in each case in the area of the ends of its legs 78. The U-profile 74 is fixed by means of this flange 79 to a rear wall of an inner housing shell 58 as inner housing.

The T-profile 64 arranged between the legs 77 of the U-profile 74 features a profile rear 65 and a center rib 66. While the long end 67 of the center rib 66 rest to form a seal against the inner side of the rear 75 of the U-profile 74, the long ends 68 of the T-profile rear 65 come to rest on the inner sides of the legs 73 of the U-profile 74 to form a seal, so that two independent cooling-air ducts 82 and 84 are embodied and the center rib 66 supports the U-profile rear 75. The side surface of the profile rear 65 facing away from the center rib 66 rests against the rear wall of the inner housing shell 58 and is fixed there by means of an adhesive.

Arranged on the inner side of the rear 75 of the U-profile 74 are two rails 80 running in parallel to one another extending in the direction or air flow as positioning aids. Accommodated between the rails 80 spaced from each other is an area of the center rib 66 lying at the long end 67. To enable cooling air to be transferred from the cooling-air ducts 82 and 84 into a cooling compartment, each of the cooling-air lines 82 and 84 of the cooling-air duct 62 is equipped with air vent openings 86 as air passage opening which penetrate the rear 65 of the T-profile 64 and appropriate points the rear wall of the inner housing shell 58.

Figure 4:
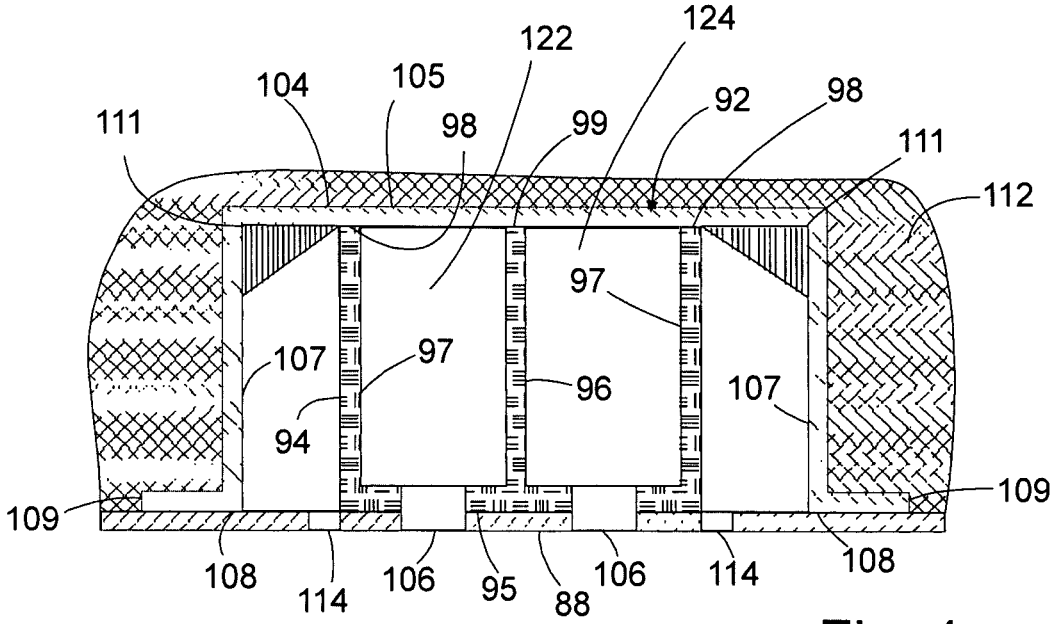
FIG. 4 a view corresponding to that shown in FIG. 2 of a third embodiment of the invention.

FIG. 4 shows a view of a third embodiment of a refrigeration device as a refrigerator similar to that shown in FIG. 2. The refrigerator includes a cooling-air duct 92 which is formed from a U-profile 104 as rear wall element and an E-profile 94 as shaped part. The U-profile 104 surrounded on the outside by a foam 112 made from plastic material features a profile rear 105 and two legs 107, in the area of the long ends 108 of which is arranged a flange 109 pointing outwards in each case. The flanges 109 rest on a rear wall of an inner housing shell 88 as inner housing and are fixed to this by means of an adhesive to secure the U-profile 104 to the inner housing shell 88.

The E-profile 94 arranged between the legs 107 of the U-profile 104 features a profile rear 95, two side bars 97 and a center rib 96 arranged between these bars 97. The E-profile 94 resting with its free rear side on the inner housing shell 88 rests with the long ends 98 of the bars 97 and the long end 99 of the center rib 96 to form a seal on the inner side of the profile rear 105 and thus forms the cooling-air duct 92 with two independent cooling-air lines 122 and 124. To connect the cooling-air lines 122 and 124 for cooling down an inner space with this for an introduction of cooling air, each of the cooling air lines 122 and 124 is provided with ventilation openings 106 as air passage openings, which pass through the rear 95 of the E-profile 94 and the inner housing shell 88 at corresponding points.

The rear wall of the inner housing shell 88 is provided with markings in the form of rectangular cutouts 114 punched through the rear wall, along the longitudinal edges of which the E-profile 94 can be aligned during assembly before it is fixed to the inner housing shell 88 in the desired position. The punched cutouts 114 can likewise for example serve to accommodate retaining elements in the inner space 12 or 14 of an air distribution mask not shown in the figure.

In the angles of the U-profile 104 a triangular rail 111 extending in its longitudinal direction in each case is fixed as a positioning aid. After the assembly of the E-profile 94 on the outside of the rear wall of the inner housing shell 88, in the assembly of the U-profile 104 this can be folded over the E-profile 94 and placed on the outer side of the inner housing shell 88, with the outer edges of the long ends 98 of the profile legs 107 in conjunction with side surfaces of the triangular rails 111 facing towards the outer sides of the profile legs 107 reliably guiding the U-profile 104 into the desired position.

The triangular rails 111, which are shown in FIG. 4 offset from the U-profile 104, could naturally be integrated as a single part into the contour of U-profile. To achieve the locating effect which makes the correct positioning of the U-profile palpable during assembly, the triangular rails can also be replaced by the rails 80 of FIG. 3 or can be combined with these.

The invention claimed is:

1. A refrigerator comprising:

a.) an outer housing;

b.) an inner housing at a spacing from the outer housing and surrounded thereby with a hollow space produced between the outer housing and the inner housing, the hollow space being foam-filled for insulation purposes;

c.) a cooling-air duct for distribution of cooling air; and d.) an inner chamber surrounded by the inner housing, the inner chamber being cooled by circulation of cooling air supplied to the inner chamber by the cooling-air duct, the cooling air duct being arranged between the outer housing and the inner housing and the cooling-air duct being formed of a shaped part having (i) insulating material that lies against an outer side of the inner housing and (ii) a closed rear wall element that touches the inner housing.

2. The refrigerator as claimed in claim 1, wherein the closed rear wall element is configured as a U-shape profile rear wall element having two profile legs that each touch the inner housing.

3. The refrigerator as claimed in claim 2, wherein the shaped part includes an extended plate having longitudinal edges that each lie against a respective one of inner sides of the two profile legs of the U-shape profile rear wall element.

4. The refrigerator as claimed in claim 2, wherein the cooling-air duct includes at least one support element arranged between the inner side of a profile rear of the U-shape profile rear wall element and an area of the inner housing covered by the rear wall element, in order to support the profile rear of the U-shape profile rear wall element on the inner housing.

5. The refrigerator as claimed in claim 4, wherein the at least one support element extends in a direction of air flow along a center line of the cooling-air duct.

6. The refrigerator as claimed in claim 5, wherein the at least one support element is a center rib of the shaped part.

7. The refrigerator as claimed in claim 2, wherein the shaped part includes an extended plate having longitudinal edges in the form of angled bars in contact with the inner side of a profile rear of the U-shape profile rear wall element.

8. The refrigerator as claimed in claim 7, wherein the outer sides of the bars are at a distance from adjoining leg inner sides of the U-shape profile rear wall element.

9. The refrigerator as claimed in claim 1, wherein the inner housing is provided with at least one marking indicating an intended assembly position of the shaped part.

10. The refrigerator as claimed in claim 2, wherein, on the inner side of a profile rear of the U-shape profile rear wall element, a rail operating in conjunction with the shaped part is formed for fixing the position of the U-shape profile rear wall element in relation to the shaped part.

11. The refrigerator as claimed in claim 2, wherein the two profile legs of the rear wall element facing towards the inner housing are each provided with a flange resting against the inner housing.

12. The refrigerator as claimed in claim 1, wherein the shaped part and the inner housing are provided with air passage openings at corresponding points.

13. The refrigerator as claimed in claim 1, wherein the closed rear wall element is a plastic closed rear wall element.

14. The refrigerator as claimed in claim 13, wherein the plastic closed rear wall element is a U-shape profile rear wall element having two profile legs that each contact the inner housing.

15. The refrigerator as claimed in claim 14, wherein the insulating material of the shaped part includes an extended plate having longitudinal edges that each lie against a respective one of inner sides of the two profile legs of the U-shape profile rear wall element.

16. The refrigerator as claimed in claim 14, wherein the cooling-air duct includes at least one support element between a profile rear of the U-shape profile rear wall element and the inner housing, a first end of the at least one support element contacting the profile rear and a second end of the at least one support element contacting the inner housing.

17. The refrigerator as claimed in claim 14, wherein each of the two profile legs of the rear wall element includes a flange extending from an outer side of each of the two profile legs of the U-shape profile rear wall element, the flange contacting the inner housing.

18. The refrigerator as claimed in claim 2, wherein the insulating material of the shaped part includes an extended plate having longitudinal edges that each lie against a respective one of inner sides of the two profile legs of the U-shape profile rear wall element.

19. The refrigerator as claimed in claim 2, wherein the cooling-air duct includes at least one support element between a profile rear of the U-shape profile rear wall element and the inner housing, a first end of the at least one support element contacting the profile rear and a second end of the at least one support element contacting the inner housing.

20. The refrigerator as claimed in claim 2, wherein each of the two profile legs of the rear wall element includes a flange extending from an outer side of each of the two profile legs of the U-shape profile rear wall element, the flange contacting the inner housing.

21. A refrigerator comprising:

an outer housing;

an inner housing inside the outer housing and spaced apart from the outer housing;

foam insulation between the outer housing and the inner housing;

an inner chamber surrounded by the inner housing; and a cooling-air duct for supplying cooling air to the inner chamber, wherein the cooling air duct is between the outer housing and the inner housing, wherein the cooling-air duct includes:

a rear wall element having two legs, each of the two legs contacting the inner housing; and an insulating plate contacting an outer side of the inner housing and disposed between inner sides of the two legs of the rear wall element.

* * * * *